US006516077B1

(12) United States Patent
Yamaguchi et al.

(10) Patent No.: US 6,516,077 B1
(45) Date of Patent: Feb. 4, 2003

(54) ELECTROACOUSTIC TRANSDUCER

(75) Inventors: Fumihiko Yamaguchi, Akishima (JP); Hideo Koreeda, Akishima (JP)

(73) Assignee: Foster Electric Company, Tokyo (JP)

( * ) Notice: Subject to any disclaimer, the term of this patent is extended or adjusted under 35 U.S.C. 154(b) by 271 days.

(21) Appl. No.: 09/676,898

(22) Filed: Oct. 2, 2000

(30) Foreign Application Priority Data

Nov. 1, 1999 (JP) ..... 11-310736

(51) Int. Cl.[7] ..... H04R 25/00
(52) U.S. Cl. ..... 381/424; 381/423; 181/173
(58) Field of Search ..... 381/398, 423, 381/424, 432; 181/171, 172, 173

(56) References Cited

U.S. PATENT DOCUMENTS 1,732,351 A * 10/1929 Borkman ..... 181/173
4,321,434 A * 3/1982 Irie ..... 381/423
4,881,617 A * 11/1989 Faraone ..... 181/172

* cited by examiner

*Primary Examiner*—Stella Woo
*Assistant Examiner*—Suhan Ni
(74) *Attorney, Agent, or Firm*—Lynn & Lynn

(57) ABSTRACT

A diaphragm of electroacoustic transducer has an edge formed with alternately up-rolled and down-rolled portions with respect to vibration plane of the diaphragm and disposed at regular intervals in circumferential direction and with sloped-plane portions respectively connecting rims opposing above and below of adjacent ones of the up-rolled and down-rolled portions, the sloped-plane portions extending in respective tangential lines with respect to an inner periphery of the edge and intersecting the circumferential direction at an alternately opposite angle with respect to the vibration plane. The up-rolled and down-rolled portions of the edge provide an uneven shape varying in the stiffness of the portions upon vibration so as to cancel any difference in vibratory driving force from coils in a magnetic circuit, and any unbalanced vibratory driving force to the diaphragm due to magnetic flux distribution can be restrained by the uneven shape of the edge, so as to attain optimum rigidity of the diaphragm while rendering it to be well adaptable to dimensional minimization and thickness reduction.

1 Claim, 6 Drawing Sheets

ELECTROACOUSTIC TRANSDUCER

BACKGROUND OF THE INVENTION

This invention relates to such electroacoustic transducers as loudspeakers or microphones and, in particular, to an electroacoustic transducer featured in an edge of diaphragm.

DESCRIPTION OF RELATED ART

Generally, the loudspeaker comprises the diaphragm which is supported at its periphery through the edge, and various, optimum characteristics of the shape, material and so on have been required to the edge for attaining desired acoustic characteristics.

There have been various types of loudspeakers have been suggested, examples of which would be ones disclosed in U.S. Pat. No. 5,371,805 to Saiki et al. and Japanese Laid-Open Patent Publication No. 11-168793 of Koreeda and assigned to the same assignee as that of the present invention, in the latter of which, as shown in FIG. 7 of herein accompanying drawings, a loudspeaker comprises a pan-shaped yoke 1 having at outer periphery an upright part 2, a permanent magnet 3 disposed on inner bottom face of the yoke 1, a pole piece 4 placed on the magnet 3, voice coils 5 wound on a bobbin 6 and held in a magnetic gap between the upright part 2 of the yoke 1 and the pole piece 4, a dome shaped diaphragm 7 secured to top end of the bobbin 6, an up-roll type edge 8 secured to outer periphery of the diaphragm 7, and a frame 9 secured to outer periphery of the yoke's upright part 2 and supporting outer periphery of the edge 8.

In the foregoing loudspeaker, the diaphragm 7 supported at the outer periphery through the edge 8 for the vibration shows an asymmetric linearity at the supporting part with respect to inputs, getting remarkable as the amplitude increases, so as to be a cause of generation of higher harmonics distortion. In the case of the up-rolled edge, for example, air volumes A1 and A2 discharged by the edge 8 upon vibration will be mutually different even if displacing amount in forward and rearward or upward and downward vibration of the diaphragm 7 is the same, as shown in accompanying FIG. 8. Further, as the displacing amount of the diaphragm 7 increases, the difference in the discharged air amount becomes larger and, in elastic control zone, the sound pressure of the loudspeaker is proportional to the sum of discharged air volumes by the diaphragm 7 and the edge 8. Due to this, there arises a problem that a difference in the sound pressure of the forward and rearward movements of the vibration increases as the vibratory amplitude of the diaphragm 7 increases and, consequently, the higher harmonics distortion increases.

A solution for the above problem has been disclosed in Japanese Patent No. 2,568,786, in which a loudspeaker 20 has an edge 21, as shown in accompanying FIGS. 9 and 10, which is divided into a plurality of parts in lengthwise, circumferential direction, such that adjacent ones 22 and 23 of these divided parts are alternately up-rolled and down-rolled to be symmetrical in section on forward and rearward sides of the circumferential direction, circumferentially spaced and oppositely rolled rims of the adjacent divided parts 22 and 23 are mutually connected with a connecting part 24 of a section sequentially, gradually varying from up-rolled shape to down-rolled shape, and the edge 21 is coupled along the inner periphery to a diaphragm 25 and along the outer periphery to a frame 26.

With such symmetrical structure as referred to in the above of the adjacent ones of the divided parts 22 and 23 in the edge 21, a composite volume of air discharged by the up-rolled divided parts and by the down-rolled divided parts upon vibration of the diaphragm 25 will be equal throughout up and down amplitudes with respect to neutral point of no input signal, at every divided parts 22 and 23 connected to any one of the connecting parts 24.

However, the diaphragm 25 driven through, as shown in FIG. 11, voice coils 28 disposed for vibratory motion in a magnetic gap 27 of magnetic circuit 26 involves a problem that magnetic flux distribution in axial direction of the gap 27 will not be uniform.

That is, the magnetic circuit shown in FIG. 11 is of a general outer magnet type comprising a yoke 29 having a center core, a ferrite magnet 30 enclosing outer periphery of the center core, and a pole piece plate 31 disposed on the magnet 30 to form the magnetic gap 27, wherein, when a center line 32 denoted by a broken line in axial, thickness direction of the gap 27 is made a reference line, the magnetic flux distribution denoted by a curve 33 in FIG. 12 shows a remarkable attenuation on upper side of the reference line 32 and a less attenuation on lower side of the line 32, so that a driving force F of the voice coils 28 moved upward will be smaller than a driving force F' of the voice coils 28 moved downward, so as to be unbalanced. While the description is made here with respect to non-linearity of the outer magnet type magnetic circuit 26, the situation applies similarly to the case of an inner magnet type.

Even when the edge 21 is made symmetrical in structure of the adjacent ones of the divided up-rolled and down-rolled parts 22 and 23, the magnetic circuit 26 shows the non-linearity, and the problem that an excellent tone quality cannot be obtained theoretically still remains unsolved.

SUMMARY OF THE INVENTION

The present invention has been suggested to solve the foregoing problems, and it is an object to provide an electroacoustic transducer having a diaphragm capable of restraining the unbalance in the vibratory driving force due to magnetic flux distribution by means of a unique structure of the edge, so as to reduce mainly the even higher harmonics distortion and to enable an excellent tone quality to be obtainable. Further, it is another object of the invention to provide an electroacoustic transducer capable of attaining a proper rigidity of configuration as compared with the foregoing prior art, and of realizing the dimensional minimization as well as thickness minimization.

The present invention attains the above object by providing an electroacoustic transducer including a diaphragm having an edge which comprises a plurality of divided portions formed at regular intervals in circumferential direction and alternately up-rolled and down-rolled with respect to a vibration plane of the diaphragm, and a plurality of sloped-plane portions respectively for connecting between mutually opposing rims of adjacent ones of the up-rolled and down-rolled divided portions, the sloped-plane portions respectively extending along each of first tangential lines drawn at regular intervals with respect to an inner peripheral line of the edge and transversing the circumferential direction at an angle a in a range defined between second tangential lines drawn from the inner periphery to bulged faces of the respective divided portions and the vibration plane, wherein the divided up-rolled and down-rolled portions being of mutually different curved-shape to provide different stiffness upon up and down movements for cancelling a difference in upward and downward driving force generated in magnetic circuit of the transducer.

Other objects and advantages of the present invention shall be made clear in following description detailed with reference to accompanying drawings.

While the present invention shall now be described in detail with reference to the embodiments shown in the accompanying drawings, it should be appreciated that the intention is not to limit the invention only to these embodiments shown but rather to include all alterations, modifications and equivalent arrangements possible within the scope of appended claim.

DETAILED DESCRIPTION OF THE PREFERRED EMBODIMENTS

In the present invention, an edge provided along outer periphery of a diaphragm forming a loudspeaker as an electroacoustic transducer comprises divided portions alternately up-rolled and down-rolled, which portions are formed asymmetric for preventing an unbalance from occurring in the vibratory driving force due to non-linearity of the magnetic circuit in the loudspeaker.

Figure 1:
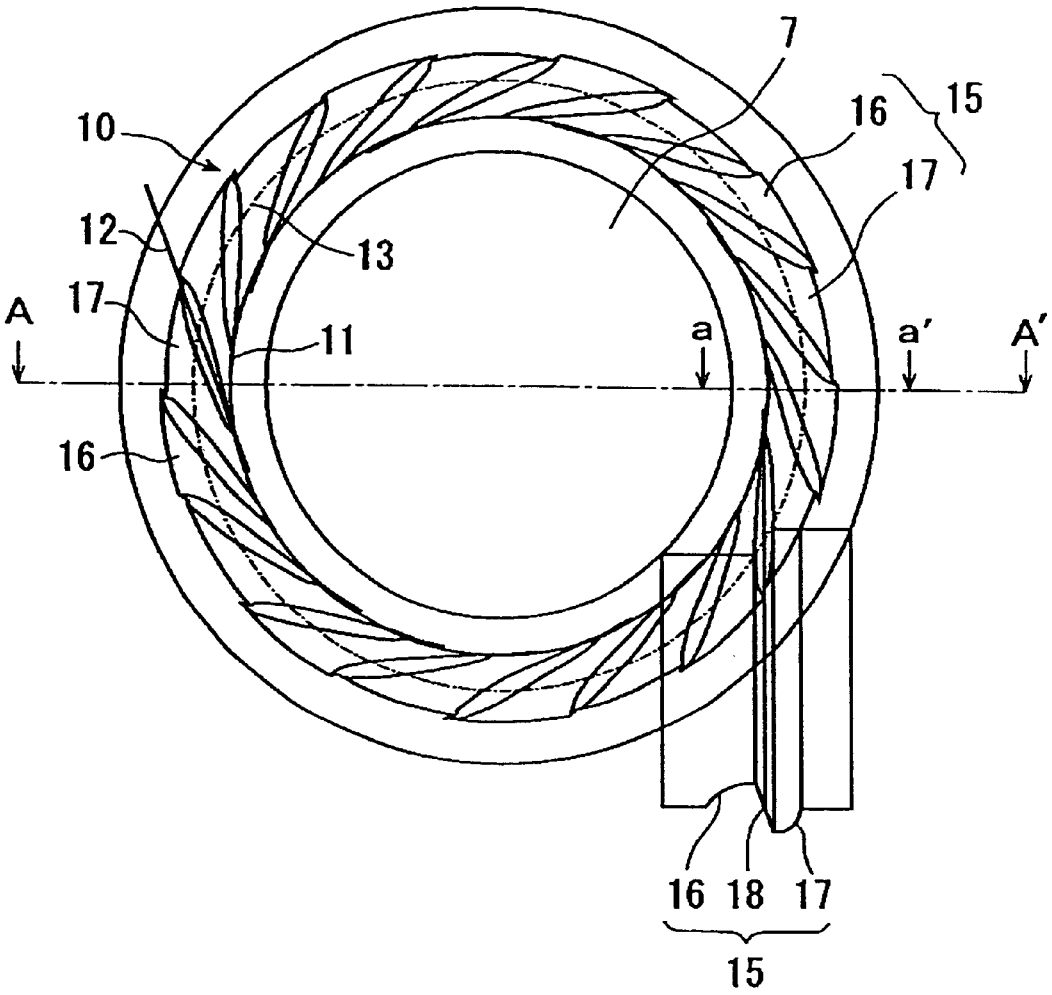
FIG. 1 is a plan view in an embodiment of a loudspeaker diaphragm forming the electroacoustic transducer according to the present invention.
Figure 2:
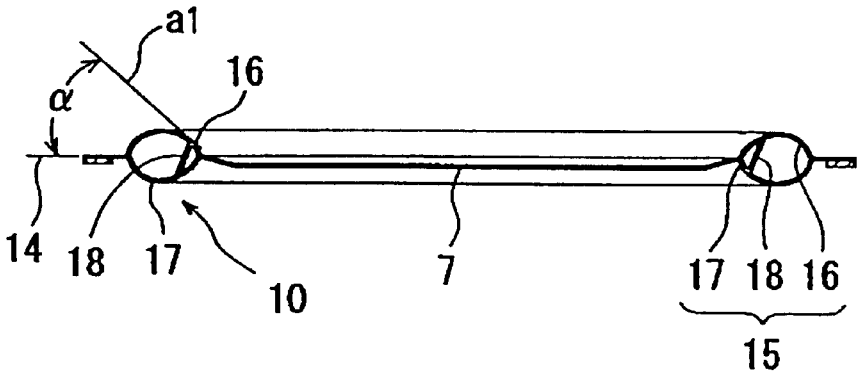
FIG. 2 is a central sectioned view as cut along a diametral line A–A' in FIG. 1.

In FIGS. 1 and 2, an embodiment of the transducer in an embodiment according to the present invention is shown, in which the diaphragm 7 of the loudspeaker is provided along its outer periphery with an edge 10 which comprises a plurality of divided rolled portions 15 formed at regular intervals in circumferential direction of the edge 10 and to respectively extend substantially along tangential lines 12 with respect to inner peripheral line 11 of the edge 10. For easy understanding of sectional shape of the divided rolled portions 15, a cut end view thereof is shown substantially at 4 o'clock position in FIG. 1.

More particularly, the divided rolled portions 15 of the edge 10 are formed in a combination of alternately up-rolled and down-rolled portions 16 and 17. That is, the up-rolled portions 16 and down-rolled portions 17 are respectively disposed alternately in the circumferential direction 13 of the edge 10. In the present embodiment, further, adjacent ones of the up-rolled and down-rolled portions 16 and 17 are mutually connected at their circumferential end rims opposing on both side of vibration plane 14 of the diaphragm 7 by means of respective connecting plane portions 18 sloped at an angle $\alpha$ ($\alpha$=40° to 90°) with respect to the vibration plane 14. In the present invention, the sloped connecting plane portions 18 are respectively formed to extend in plan view of FIG. 1 substantially along each of tangential lines 12 with respect to the inner peripheral line 11 of the edge 10. As will be detailed later, in the present invention, the up-rolled and down-rolled portions 16 and 17 are made to be mutually slightly different in the shape, so as to be of a unique arrangement. In addition to the mutually different shape of the up-rolled and down-rolled portions 16 and 17, the connection between the adjacent ones of these portions 16 and 17 by means of the sloped plane portions 18 is effective to attain the optimum rigidity of the edge. The foregoing angle $\alpha$ is made to correspond to an angle defined by the vibration plane 14 and tangential line al in vertically sectional view of FIG. 2 as drawn with respect to the inner peripheral line of the edge 10.

Figure 3:
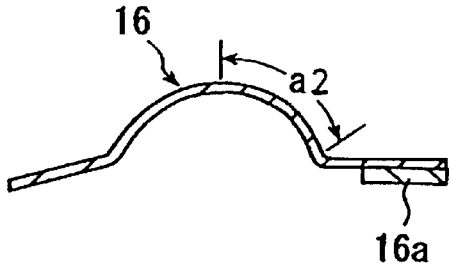
FIG. 3 is a fragmentary sectioned view at an up-rolled divided portion in the edge of the diaphragm of FIG. 1.
Figure 4:
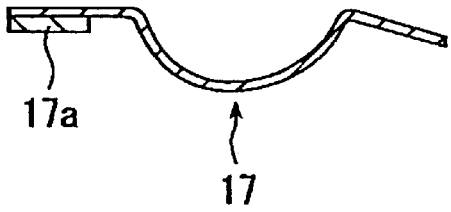
FIG. 4 is a fragmentary sectioned view at a down-rolled divided portion formed in the edge of the diaphragm of FIG. 1 adjacent in the circumferential direction to the up-rolled portion.
Figure 5:
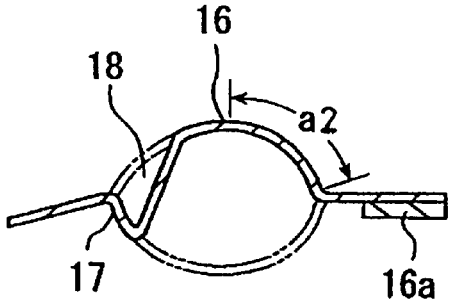
FIG. 5 is a sectioned view as magnified of the edge at a line portion a–a' of the A–A' line in FIG. 1.

According to the present invention, further, the up-rolled portions 16 respectively have a curved surface portion a2 substantially from the central part to outer periphery as shown in FIG. 3, which portion a2 is bulged towards outer upward as compared with corresponding portion of the down-rolled portion 17 as shown in FIG. 4, so as to be mutually asymmetrical. That is, while in the present invention the sum of air volume discharged by the up-rolled portions 16 is substantially equalized to that by the down-rolled portions 17, the up-rolled portions 16 are bulged outward at outer peripheral curved surface portion, while the down-rolled portions 17 are bulged outward on the inner peripheral side, so that a resistance component will be increased in downward movement, toward the side of the down-rolled portions 17.

Further, a reinforcing member 16*a* is provided to lower surface of an outer peripheral part of the up-rolled portion 16 (see FIG. 3), and a further reinforcing member 17*a* is provided to lower surface of an inner peripheral part (see FIG. 4).

Figure 6:
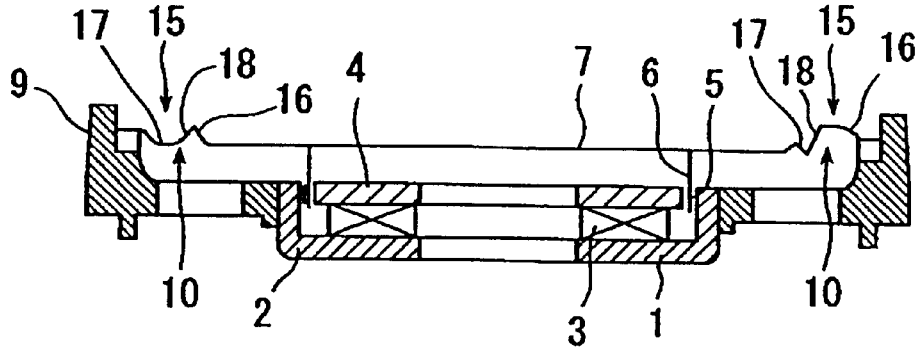
FIG. 6 is a cross sectioned view of a loudspeaker as the electroacoustic transducer including the diaphragm of FIG. 1.
Figure 7:
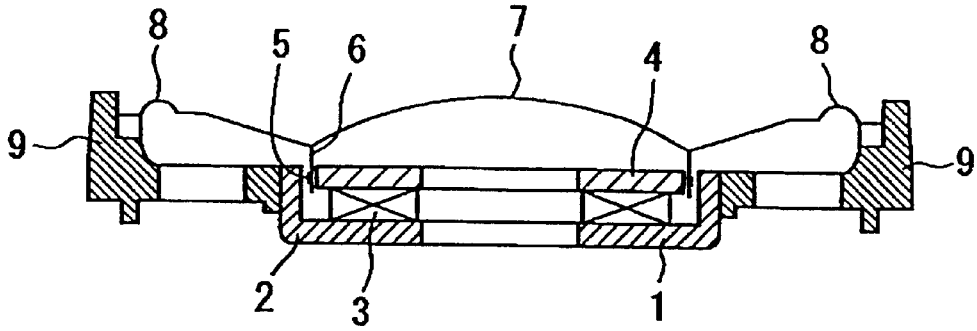
FIG. 7(PRIOR ART)
FIG. 7 is a cross sectioned view of a known loudspeaker.
Figure 8:
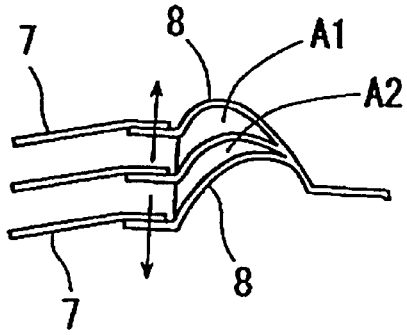
FIG. 8(PRIOR ART)
FIG. 8 is an explanatory view of the operation of the known loudspeaker of FIG. 7.
Figure 9:
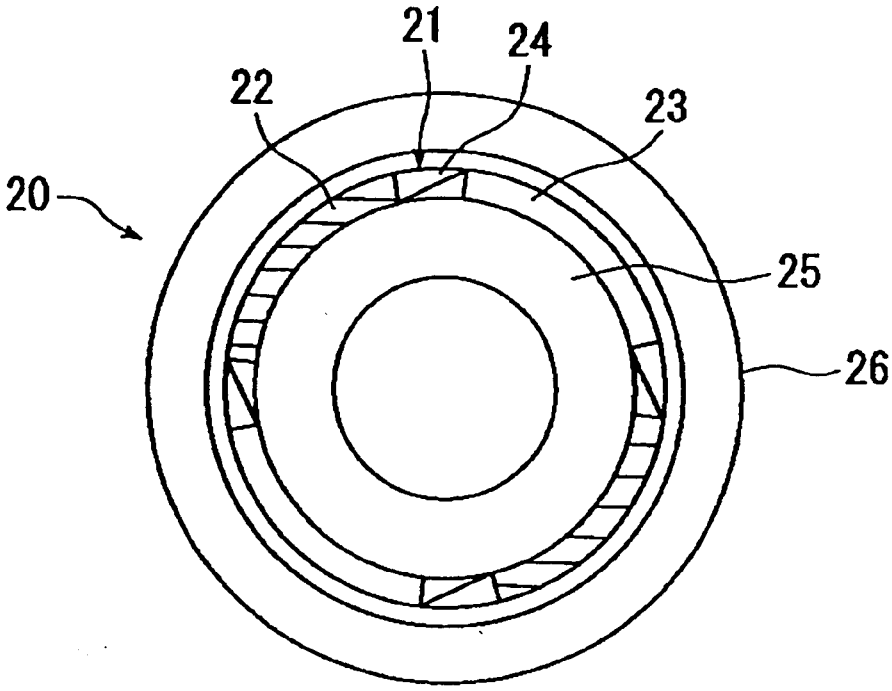
FIG. 9 (PRIOR ART)
FIG. 9 is a plan view of another known loudspeaker.
Figure 10:
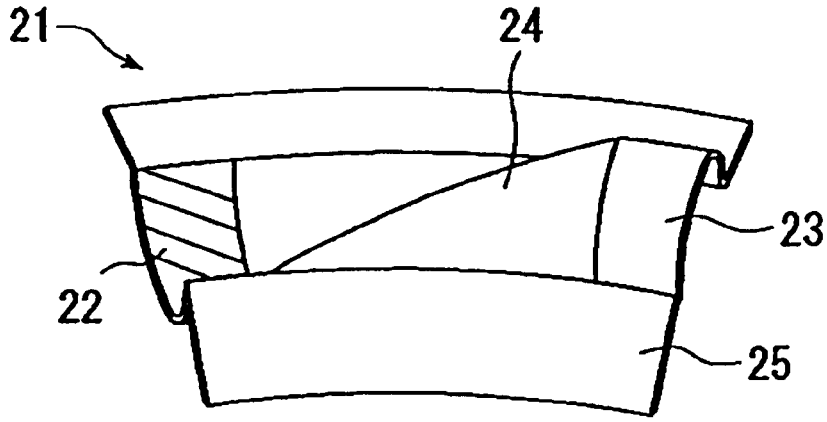
FIG. 10 (PRIOR ART)
FIG. 10 is a fragmentary perspective view as magnified at an edge of a diaphragm of the loudspeaker in FIG. 9.

In FIG. 6, an aspect of the loudspeaker incorporating the foregoing diaphragm 7 and edge 10 is shown, in which the loudspeaker comprises a pan-shaped yoke 1 having at its peripheral edge an upright part 2, a permanent magnet 3 disposed on inner bottom face of the yoke 1, a pole piece plate 4 placed on the magnet 3, a voice coil bobbin 6 on which voice coils 5 are wound and disposed in a magnetic gap defined between outer periphery of the plate 4 and inner periphery of the yoke's upright part 2, and a frame 9 secured to outer periphery of the yoke's upright part 2 and supporting outer peripheral part of the edge 10 of the diaphragm 7.

Figure 12:
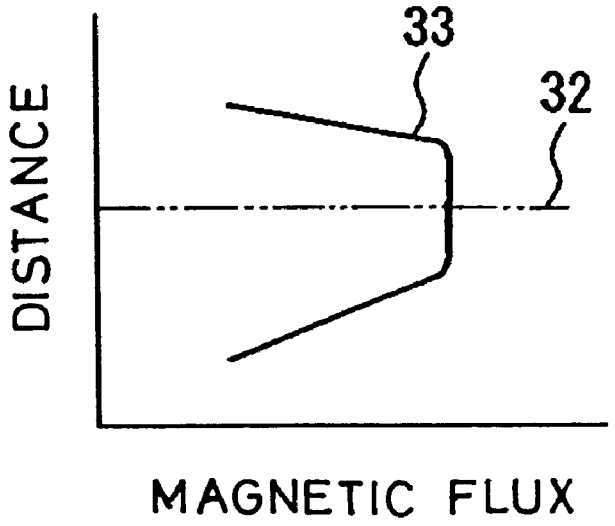
FIG. 12 is an explanatory diagram for showing magnetic flux distribution in the circuit of FIG. 11.

Referring next to the operation of the loudspeaker according to the present invention, the up-rolled portions 16 of the diaphragm edge 10 are bulged at their surface part substantially from the center to the outer periphery, so that the resistance increases upon downward vibratory motion, as has been disclosed. In respect of the magnetic flux distribution in the magnetic gap, the flux is caused to be remarkably attenuated on upper side part of the gap in general even in the magnetic circuit of the inner magnet type as has been referred to with reference to FIG. 12, and the upward vibratory driving force is thereby made smaller than the downward vibratory driving force.

Figure 11:
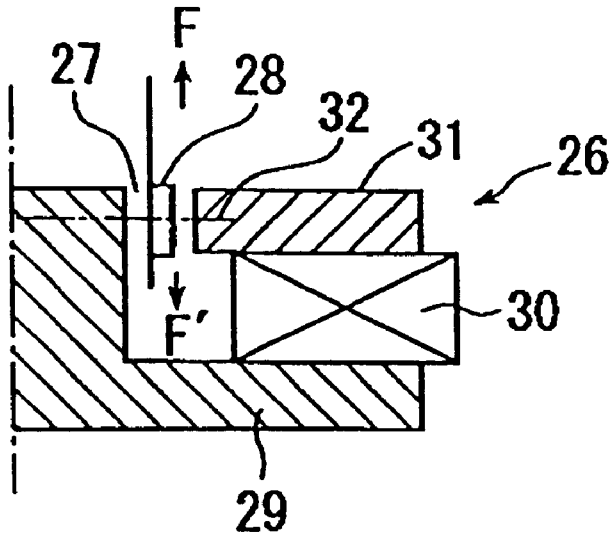
FIG. 11 is an explanatory view for a magnetic circuit in another embodiment according to the present invention.
Figure 13:
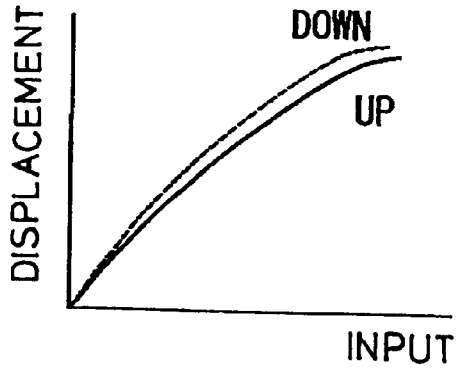
FIG. 13 is a diagram showing voice coil input-to-displacement characteristics in the magnetic circuit of FIG. 11.
Figure 14:
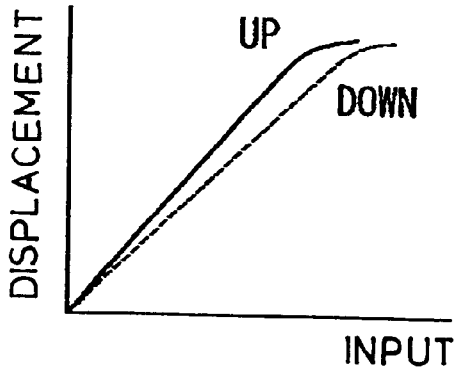
FIG. 14 is a diagram showing load-to-displacement characteristics in the edge used in another embodiment according to the present invention.
Figure 15:
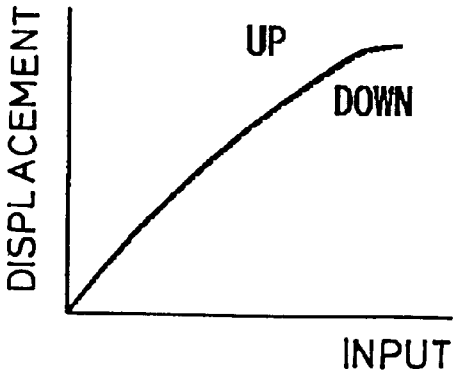
FIG. 15 is a diagram showing displacing characteristics of the diaphragm in an embodiment where the magnetic circuit in the embodiment of FIG. 11 is combined with the edge of the load-to-displacement characteristics shown in FIG. 14.

In FIG. 13, input-displacement characteristics of the voice coils 5 in the magnetic circuit 26 of FIG. 11 are shown, FIG. 14 shows load-displacement characteristics of the edge 10 of the present invention, and FIG. 15 shows displacement characteristics of the diaphragm 7 with respect to inputs to the voice coils 5 in the combined arrangement of the magnetic circuit 26 of FIG. 11 with the edge 10 of the present invention having the load-displacement characteristics of FIG. 14.

In these FIGS. 13–15, "UP" denotes the upward movement and "DOWN" denotes the downward movement of the vibration of the diaphragm. As will be clear from FIG. 15, according to the present invention, any difference between the upward and downward driving forces due to the asymmetry in the magnetic flux distribution can be minimized by means of the provision of the different displacement characteristics to the edge 10 with the bulged shape of the up-rolled and down-rolled divided portions 16 and 17 for the improvement in non-linearity of the magnetic circuit, during the vibratory motion of the edge 10 together with the diaphragm 7 driven through the voice coils 5 in the magnetic gap.

That is, in the present invention, the up-rolled and down-rolled portions 16 and 17 of the edge 10 are so arranged that, during the vibratory motion of the diaphragm 7 and edges 10, the discharged air volumes of both rolled portions 16 and 17 upon their motion are substantially equalized to reduce the higher harmonics distortion caused by the asymmetricity of the discharge air volume, any unbalance in the vibratory driving force caused by the non-linearity in the magnetic circuit can be cancelled by the slightly different shape between the up-rolled and down-rolled portions 16 and 17 so as to reduce mainly the even higher harmonics distortion, and thereby an excellent tone quality can be obtained.

According to the foregoing embodiments of the present invention, the asymmetry between the up-rolled and down-rolled divided portions 16 and 17 of the edge 10 which are adjacent to each other in the circumferential direction is realized by the differentiation in the bulged shape between these portions 16 and 17. Examples of other measures will be as follows, which can attain the same operation and effect:

(1) To have the radius of the up-rolled and down-rolled portions 16 and 17 made different from each other.

(2) To have the height of the up-rolled and down-rolled portions 16 and 17 made different from each other.

(3) To have the center line of the respective up-rolled and down-rolled portions 16 and 17 deviated on outer peripheral side or on inner peripheral side.

What is claimed is:

1. An electroacoustic transducer including a diaphragm having an edge, the edge comprising a plurality of divided portions formed at regular intervals in circumferential direction and alternately up-rolled and down-rolled with respect to a vibration plane of the diaphragm, and a plurality of sloped-plane portions respectively for connecting between mutually opposing rims of adjacent ones of the up-rolled and down-rolled divided portions, the sloped-plane portions respectively extending along each of first tangential lines drawn at regular intervals with respect to an inner peripheral line of the edge and transversing the circumferential direction at an angle $\alpha$ in a range defined between second tangential lines drawn from the inner periphery to bulged faces of the respective divided portions and the vibration plane, wherein the divided up-rolled and down-rolled portions being of mutually different curved-shape to provide different stiffness upon up and down movements for cancelling a difference in upward and downward driving force generated in magnetic circuit of the transducer.

* * * * *